US005482276A

United States Patent [19]

Hall

[11] Patent Number: 5,482,276

[45] Date of Patent: Jan. 9, 1996

[54] PLAYING CARD HOLDER

[76] Inventor: Laurence S. Hall, 73 Mels, Lakeland, Fla. 33801

[21] Appl. No.: 369,149

[22] Filed: Jan. 5, 1995

[51] Int. Cl.[6] ..... A63F 1/10

[52] U.S. Cl. ..... 273/150; 40/124.4; 40/658

[58] Field of Search ..... 273/150, 148 A; 40/124.4, 124, 658, 657

[56] References Cited

U.S. PATENT DOCUMENTS 854,313 5/1907 Slazenger ..... 273/150

FOREIGN PATENT DOCUMENTS 357128 1/1918 Germany ..... 273/150

*Primary Examiner*—Benjamin H. Layno

[57] ABSTRACT

A holder for supporting a plurality of playing cards in a desired orientation. The inventive device includes a support for positioning on a horizontal surface. A plurality of engaging assemblies are secured to the support and are each operable for receiving and supporting an individual playing card thereon.

13 Claims, 4 Drawing Sheets

PRIOR ART

FIG. 7
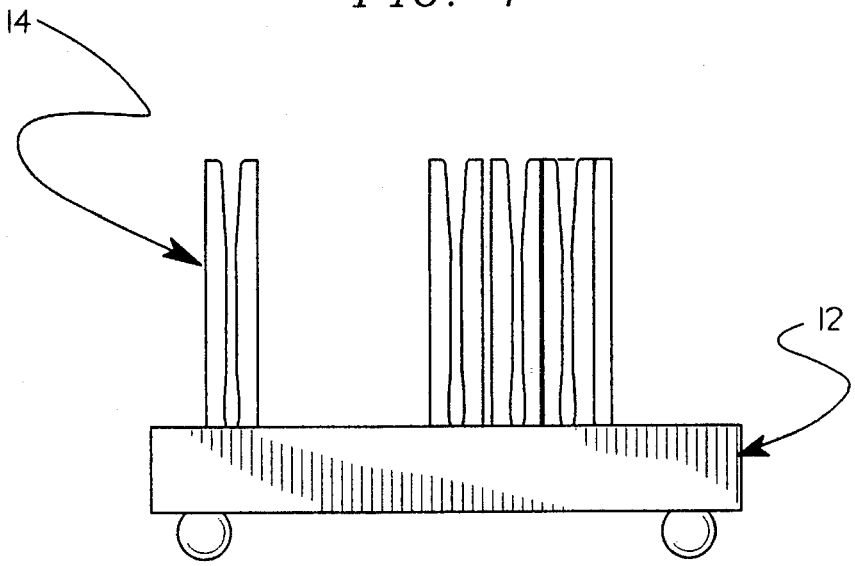
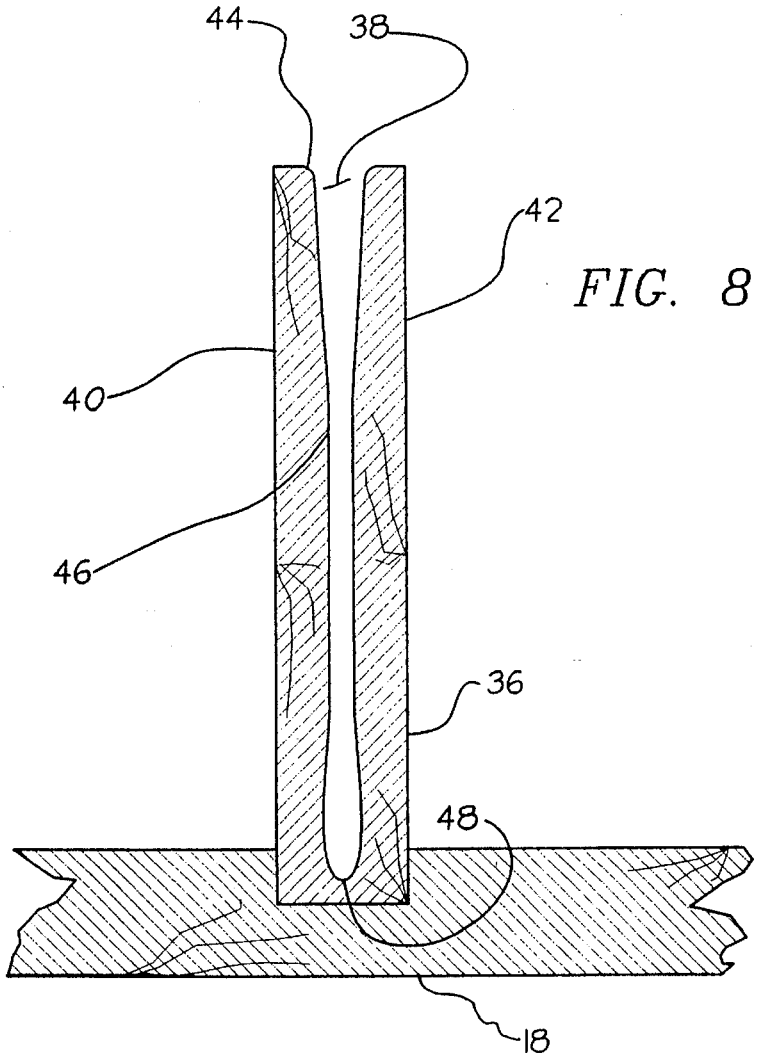
FIG. 8

PLAYING CARD HOLDER

BACKGROUND OF THE INVENTION

1. Field of the Invention

The present invention relates to support structures and more particularly pertains to an playing card holder for supporting a plurality of playing cards in a desired orientation.

2. Description of the Prior Art

The use of support structures is known in the prior art. More specifically, support structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art support structures include U.S. Pat. Nos. 4,927,149; 4,630,824; 4,538,813; 4,073,494 and 3,791,651.

While these devices fulfill their respective, particular objectives and requirements, the aforementioned patents do not disclose a playing card holder for supporting a plurality of playing cards in a desired orientation which includes a support for positioning on a horizontal surface, and a plurality of engaging means secured to the support and each being operable for receiving and supporting an individual playing card therein.

In these respects, the playing card holder according to the present invention substantially departs from the conventional concepts and designs of the prior art, and in so doing provides an apparatus primarily developed for the purpose of supporting a plurality of playing cards in a desired orientation.

SUMMARY OF THE INVENTION

In view of the foregoing disadvantages inherent in the known types of support structures now present in the prior art, the present invention provides a new playing card holder construction wherein the same can be utilized for supporting a plurality of playing cards. As such, the general purpose of the present invention, which will be described subsequently in greater detail, is to provide a new playing card holder apparatus and method which has many of the advantages of the support structures mentioned heretofore and many novel features that result in a playing card holder which is not anticipated, rendered obvious, suggested, or even implied by any of the prior art support structures, either alone or in any combination thereof.

To attain this, the present invention generally comprises a holder for supporting a plurality of playing cards in a desired orientation. The inventive device includes a support for positioning on a horizontal surface. A plurality of engaging assemblies are secured to the support and are each operable for receiving and supporting an individual playing card thereon.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new playing card holder apparatus and method which has many of the advantages of the support structures mentioned heretofore and many novel features that result in a playing card holder which is not anticipated, rendered obvious, suggested, or even implied by any of the prior art support structures, either alone or in any combination thereof.

It is another object of the present invention to provide a new playing card holder which may be easily and efficiently manufactured and marketed.

It is a further object of the present invention to provide a new playing card holder which is of a durable and reliable construction.

An even further object of the present invention is to provide a new playing card holder which is susceptible of a low cost of manufacture with regard to both materials and labor, and which accordingly is then susceptible of low prices of sale to the consuming public, thereby making such playing card holders economically available to the buying public.

Still yet another object of the present invention is to provide a new playing card holder which provides in the apparatuses and methods of the prior art some of the advantages thereof, while simultaneously overcoming some of the disadvantages normally associated therewith.

Still another object of the present invention is to provide a new playing card holder for supporting a plurality of playing cards in a desired orientation for playing of a card game.

Yet another object of the present invention is to provide a new playing card holder which includes a support for positioning on a horizontal surface, and a plurality of engaging means secured to the support and each being operable for receiving and supporting an individual playing card therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is an end elevation view as seen from line 7—7 of FIG. 5.

FIG. 8 is a cross sectional view taken along line 8—8 of FIG. 6.

DESCRIPTION OF THE PREFERRED EMBODIMENT

Figure 1:
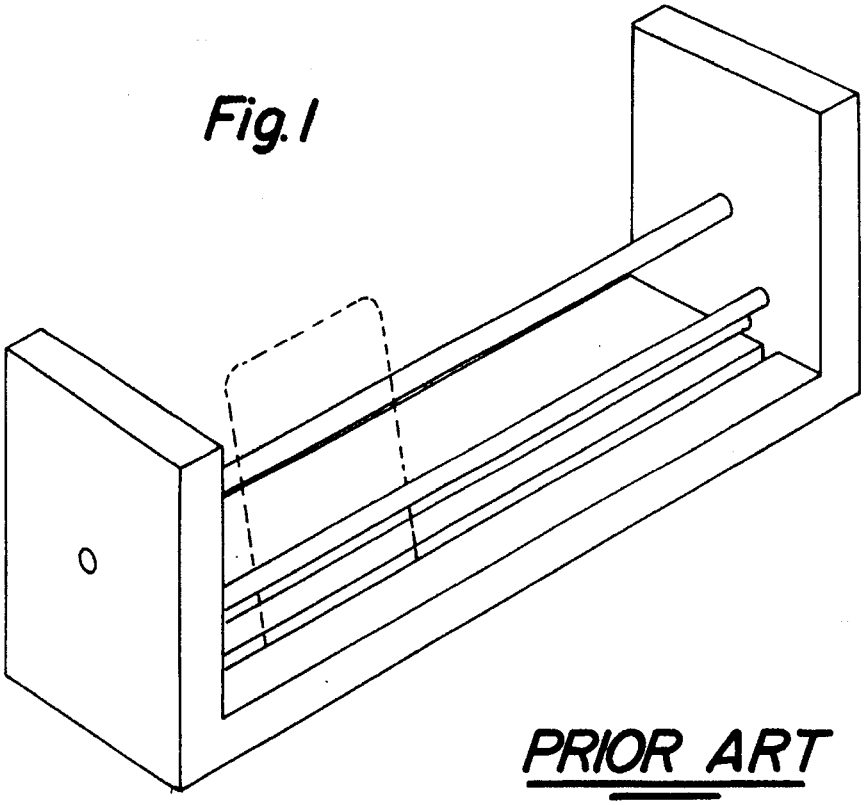
FIG. 1 is an isometric illustration of a prior art support structure.

With reference now to the drawings, and in particular to FIGS. 3–8 thereof, a new playing card holder embodying the principles and concepts of the present invention and generally designated by the reference numeral 10 will be described.

Figure 2:
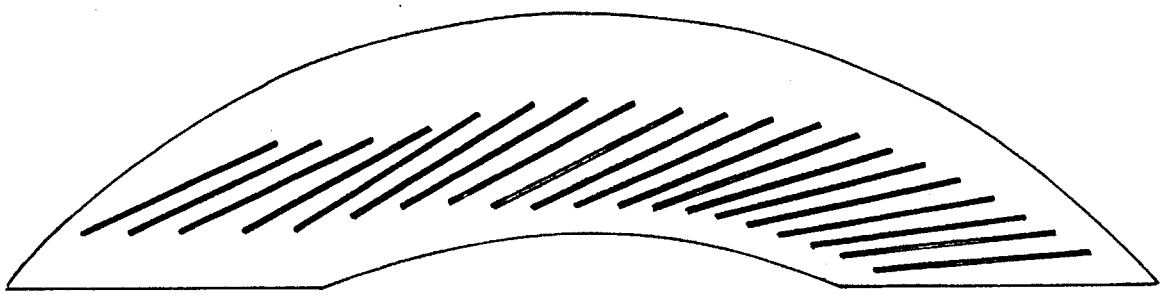
PRIOR ART Fig. 2
FIG. 2 is a top plan view of a further prior art support structure.

Turning initially to FIGS. 1 and 2 wherein prior arts support structures are illustrated, it can be shown that the prior art teaches a simple rack structure, as shown in FIG. 1, or a planar member having a plurality of slots directed thereinto, as shown in FIG. 2.

Figure 3:
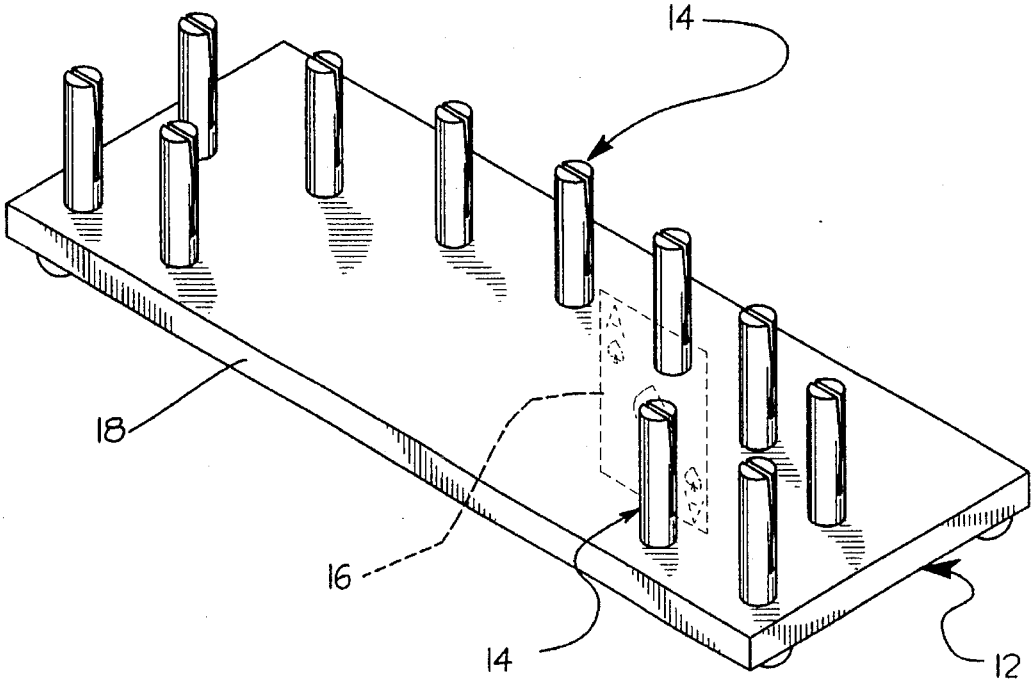
FIG. 3 is an isometric illustration of a playing card holder according to the present invention.

Turning now to FIGS. 3 through 8 wherein the playing card holder 10 according to the present invention is illustrated in detail, it can be shown that the playing holder comprises a support means 12 for positioning upon a horizontal support surface, and a plurality of engaging means 14 coupled to the support means 12 for engaging a plurality of cards 16 to support the cards relative to the support means. As shown in FIG. 3, each of the engaging means 14 is operable to receive and support an individual playing card 16 to support the playing card in a substantially vertical orientation projecting orthogonally relative to the support means 12.

Figure 4:
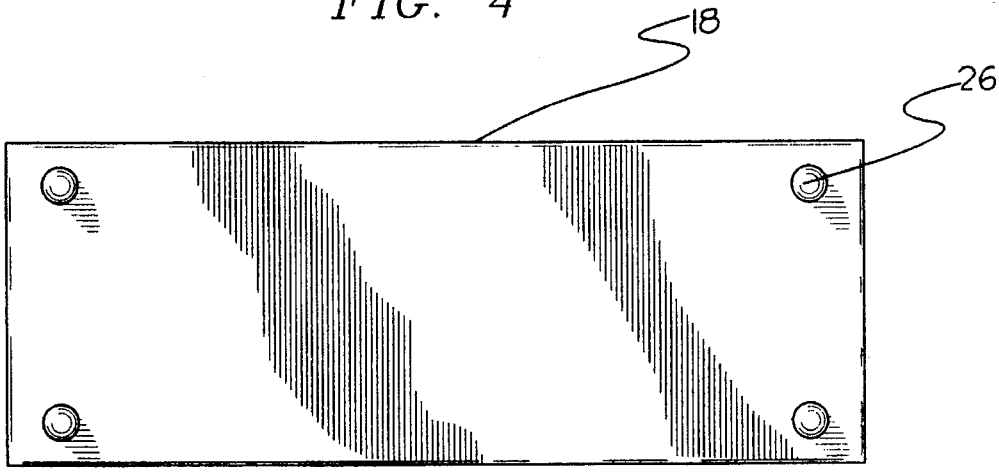
FIG. 4 is a bottom plan view thereof.
Figure 5:
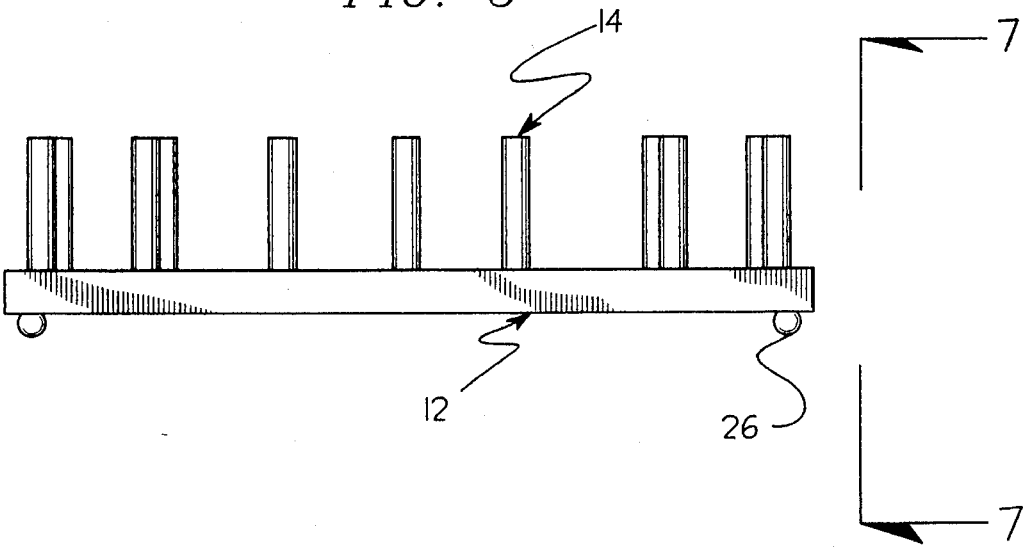
FIG. 5 is a front elevation view of the playing card holder.
Figure 6:
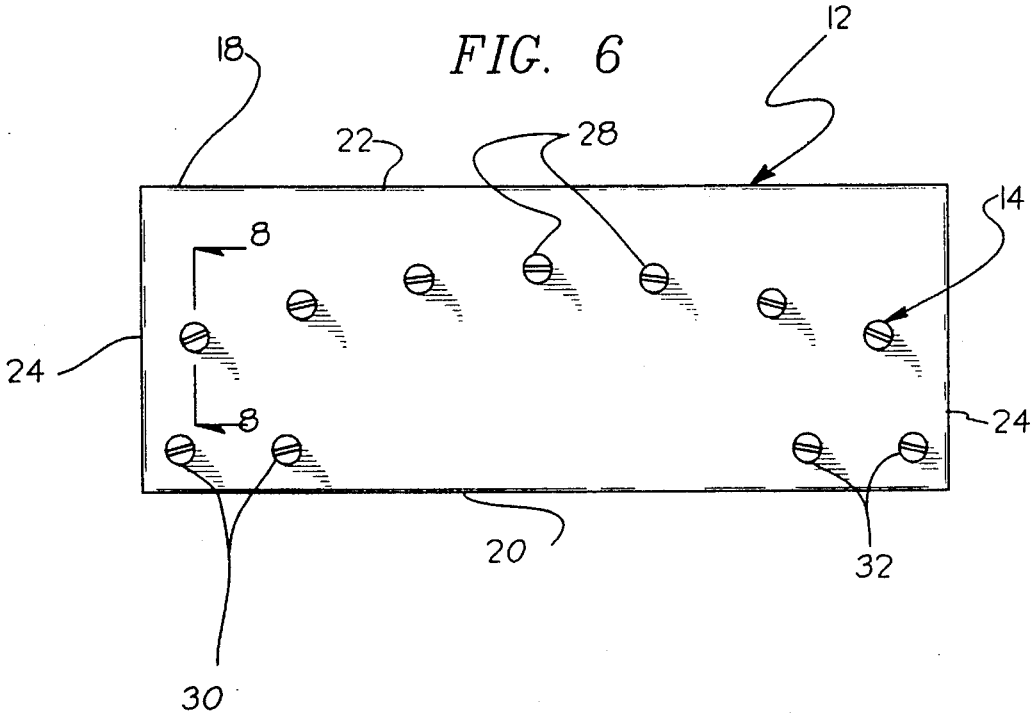
FIG. 6 is a top plan view thereof.

As best illustrated in FIG. 6, it can be shown that the support means 12 according to the present invention 10 comprises a substantially rectangular base plate 18 having a front edge 20 spaced from and oriented substantially parallel to a rear edge 22, with a pair of lateral edges 24 extending substantially orthogonally between the front and rear edges so as to define a substantially rectangular shape of the base plate 18. If desired and as shown in FIG. 4, a plurality of support feet 26 can be secured to a bottom surface of the base plate 18 to support base plate in a spaced orientation relative to a horizontal support surface upon which the support means 12 is positioned.

With continuing reference to FIG. 6, it can be shown that the engaging means 14 of the present invention 10 are arranged in a specific pattern and project from an upper surface of the base plate 18 of the support means 12. To this end, a first plurality of the engaging means 14 are arranged in an arcuate array 28 across the base plate 18. Further, a first lateral pair 30 of the engaging means 14 are positioned proximal to an intersection of a first one of the lateral edges 24 with the front edge 20. Similarly, a second lateral pair 32 of engaging means 14 is positioned proximal to an intersection of a second one of the lateral edges 24 with the front edge 20. By this structure, a first plurality of cards can be positioned within the arcuate array 28, with a further plurality of cards being positioned in the first lateral pair 30, and another further plurality of cards being positioned in the second lateral pair 32 as desired. Such configuration of the engaging means 14 permits for organization of the playing cards 16 into a desired orientation for a particular game being played.

Referring now to FIGS. 7 and 8, it can be shown that the engaging means 14 each project into an unlabeled cylindrical bore extending into the base plate 18. The engaging means 14 can be adhesively secured within the respective bores of the base plate 18, or alternatively, the engaging means may simply be gravitationally and frictionally retained within the respective bores so as to permit at least a slight rotation of the engaging means 14 relative to the base plate 18 such that the playing cards 14 positioned within the engaging means can be selectively oriented towards an unillustrated player. Preferably and as illustrated in FIG. 6, the engaging means are angled slightly such that the cards will be oriented towards the player.

Each of the engaging means 14, as best shown in FIG. 8, comprises a substantially cylindrical clamp member 36 having a longitudinal slot 38 directed thereinto separating the clamp member 36 into a first clamp leg 40 spaced from a second clamp leg 42. Thus, a playing card 16 can be positioned between the clamp legs 40 and 42 so as to be secured relative to the clamp member 36. To this end, the longitudinal slot 38 is preferably of a first transverse dimension at an upper end 44 thereof and tapers to a second transverse dimension proximal to a medial portion 46 thereof, wherein the first transverse dimension is substantially greater than the second transverse dimension such that a playing card 16 positioned between the clamp legs 40 and 42 will be frictionally engaged thereby. The longitudinal slot 38 continues from the medial portion 46 thereof to terminate in a lower end 48 of a third transverse dimension, wherein the third transverse dimension is substantially greater than the second transverse dimension. Preferably, the lower end 48 of the slot extends slightly below the top surface of the base plate 18. By this structure, playing cards 16 of various sizes can be captured within the clamp member 36, while still projecting above the upper end 44 of the longitudinal slot 38 for viewing thereof.

In use, the playing card holder 10 according to the present invention can be easily utilized to support a plurality of playing cards 16 in a descried orientation for viewing by a card player during an associated game. The playing card holder 10 is particularly useful by handicapped people who may only have one hand with which to manipulate the cards 16.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A playing card holder comprising:

a support means for positioning upon a horizontal support surface; and, a plurality of engaging means coupled to the support means for engaging a plurality of cards to support the cards relative to the support means, the support means comprising a substantially rectangular base plate having a front edge spaced from and oriented substantially parallel to a rear edge, with a pair of lateral edges extending substantially orthogonally between the front and rear edges so as to define a substantially rectangular shape of the base plate;

wherein the engaging means are arranged in a specific pattern and project from an upper surface of the base plate of the support means;

wherein said specific pattern comprises a first plurality of the engaging means arranged in an arcuate array across the base plate, a first lateral pair of the engaging means positioned proximal to an intersection of a first one of the lateral edges with the front edge; and a second lateral pair of the engaging means positioned proximal to an intersection of a second one of the lateral edges with the front edge;

wherein the base plate includes a plurality of cylindrical bores directed thereinto, and further wherein the engaging means are each positioned partially into an individual one of the bores, wherein the engaging means can be rotated relative to the base plate such that the playing cards positioned within the engaging means can be selectively oriented towards a player.

2. The playing card holder of claim 1, wherein each of the engaging means comprises a substantially cylindrical clamp member having a longitudinal slot directed thereinto separating the clamp member into a first clamp leg spaced from a second clamp leg, wherein a playing card can be positioned between the clamp legs so as to be secured relative to the clamp member.

3. The playing card holder of claim 2, wherein the longitudinal slot is of a first transverse dimension at an upper end of the clamp member and tapers to a second transverse dimension proximal to a medial portion of the clamp member, wherein the first transverse dimension is substantially greater than the second transverse dimension such that a playing card positioned between the clamp legs will be frictionally engaged thereby.

4. The playing card holder of claim 3, wherein the longitudinal slot continues from the medial portion of the clamp leg to terminate in a lower end of a third transverse dimension, wherein the third transverse dimension is substantially greater than the second transverse dimension.

5. The playing card holder of claim 4, wherein the longitudinal slot extends below a top surface of the base plate and at least partially into a respective cylindrical bore.

6. A playing card holder comprising:

a support means for positioning upon a horizontal support surface; and, a plurality of engaging means coupled to the support means for engaging a plurality of cards to support the cards relative to the support means, the support means comprising a base plate;

wherein the base plate includes a plurality of cylindrical bores directed thereinto, and further wherein the engaging means are each positioned partially into an individual one of the bores, wherein the engaging means can be rotated relative to the base plate such that the playing cards positioned within the engaging means can be selectively oriented towards a player.

7. The playing card holder of claim 6, wherein the engaging means are arranged in a specific pattern and project from an upper surface of the base plate of the support means.

8. The playing card holder of claim 7, wherein the base plate is substantially rectangular and includes a front edge spaced from and oriented substantially parallel to a rear edge, with a pair of lateral edges extending substantially orthogonally between the front and rear edges so as to define a substantially rectangular shape of the base plate.

9. The playing card holder of claim 8, wherein said specific pattern comprises a first plurality of the engaging means arranged in an arcuate array across the base plate, a first lateral pair of the engaging means positioned proximal to an intersection of a first one of the lateral edges with the front edge; and a second lateral pair of the engaging means positioned proximal to an intersection of a second one of the lateral edges with the front edge.

10. The playing card holder of claim 9, wherein each of the engaging means comprises a substantially cylindrical clamp member having a longitudinal slot directed thereinto separating the clamp member into a first clamp leg spaced from a second clamp leg, wherein a playing card can be positioned between the clamp legs so as to be secured relative to the clamp member.

11. The playing card holder of claim 10, wherein the longitudinal slot is of a first transverse dimension at an upper end of the clamp member and tapers to a second transverse dimension proximal to a medial portion of the clamp member, wherein the first transverse dimension is substantially greater than the second transverse dimension such that a playing card positioned between the clamp legs will be frictionally engaged thereby.

12. The playing card holder of claim 11, wherein the longitudinal slot continues from the medial portion of the clamp leg to terminate in a lower end of a third transverse dimension, wherein the third transverse dimension is substantially greater than the second transverse dimension.

13. The playing card holder of claim 12, wherein the longitudinal slot extends below a top surface of the base plate and at least partially into a respective cylindrical bore.

* * * * *